US009404641B2

(12) United States Patent
Belliveau et al.

(10) Patent No.: US 9,404,641 B2
(45) Date of Patent: Aug. 2, 2016

(54) THEATRE LIGHT COMPRISING OF A PLURALITY OF REMOTELY POSITIONABLE LIGHT EMITTING MODULES

(71) Applicants: Richard S. Belliveau, Austin, TX (US); Larry Bernard Roessler, Austin, TX (US)

(72) Inventors: Richard S. Belliveau, Austin, TX (US); Larry Bernard Roessler, Austin, TX (US)

(73) Assignee: BARCO LIGHTING SYSTEMS, INC., Austin, TX (US)

( * ) Notice: Subject to any disclaimer, the term of this patent is extended or adjusted under 35 U.S.C. 154(b) by 333 days.

(21) Appl. No.: 13/938,305

(22) Filed: Jul. 10, 2013

(65) Prior Publication Data

US 2015/0016106 A1 Jan. 15, 2015

(51) Int. Cl.

| | |
|---|---|
| ***F21V 14/02*** | (2006.01) |
| ***F21V 1/00*** | (2006.01) |
| ***F21S 10/02*** | (2006.01) |
| ***F21V 23/04*** | (2006.01) |
| *F21W 101/00* | (2006.01) |
| *F21W 131/406* | (2006.01) |
| *F21Y 101/02* | (2006.01) |
| *F21Y 105/00* | (2016.01) |
| *F21V 29/74* | (2015.01) |

(52) U.S. Cl.

CPC ..... *F21V 14/02* (2013.01); *F21S 10/026* (2013.01); *F21V 1/00* (2013.01); *F21V 23/0435* (2013.01); *F21V 29/74* (2015.01); *F21W 2101/00* (2013.01); *F21W 2131/406* (2013.01); *F21Y 2101/02* (2013.01); *F21Y 2105/005* (2013.01)

(58) Field of Classification Search

CPC ..... F21W 2101/00; F21V 1/00; F21V 14/02
See application file for complete search history.

(56) References Cited

U.S. PATENT DOCUMENTS

| | | | | |
|---|---|---|---|---|
| 4,392,187 | A | 7/1983 | Bornhorst | |
| 5,406,176 | A * | 4/1995 | Sugden | 315/292 |
| 6,357,893 | B1 | 3/2002 | Belliveau | |
| 7,618,150 | B2 * | 11/2009 | Chien | 362/35 |
| 7,887,217 | B2 | 2/2011 | Belliveau et al. | |
| 2006/0215120 | A1 * | 9/2006 | Belliveau | 353/30 |
| 2009/0225542 | A1 * | 9/2009 | Belliveau et al. | 362/231 |
| 2012/0147604 | A1 * | 6/2012 | Farmer | 362/249.03 |

OTHER PUBLICATIONS

Showtec XS-6 Moving Head Centrepiece, www.getinthemix.com/dj-lighting/showtec-xs-6-moving-head-centrepiece.htm, Mar. 5, 2014.

GLP German Light Products Inc.,10945 Pendleton Street,Sun Valley,CA 91352, http://www.glp.de/index.php?id=impression120&no_cache=1&L=1, Jul. 10, 2013.

The High End Systems Product Line 2001 available from Barco Lighting Systems, Inc. of Austin, Texas, Jul. 10, 2013.

* cited by examiner

*Primary Examiner* — Douglas W Owens
*Assistant Examiner* — Pedro C Fernandez
(74) *Attorney, Agent, or Firm* — Walter J. Tencza, Jr.

(57) ABSTRACT

A theater lighting apparatus including a plurality of light emitting modules or light emitting devices contained within a lamp housing each having a remotely controllable pan and tilt axis. The theater lighting apparatus is also capable of remotely positioning the lamp housing containing the plurality of light emitting modules. The theater lighting apparatus may include a base, and the lamp housing. The plurality of light emitting devices may include a first light emitting device which is individually remotely positionable to project a first light in a first direction, a second light emitting device which is individually remotely positionable to project a second light in a second direction, and a third light emitting device which is individually remotely positionable to project a third light in a third direction. The first direction, the second direction, and the third direction may be different from each other.

19 Claims, 10 Drawing Sheets

THEATRE LIGHT COMPRISING OF A PLURALITY OF REMOTELY POSITIONABLE LIGHT EMITTING MODULES

FIELD OF THE INVENTION

This invention relates to multiparameter theatre lighting fixtures comprised of a plurality of light sources.

BACKGROUND OF THE INVENTION

Multiparameter lighting fixtures are lighting fixtures, which illustratively have two or more individually remotely adjustable parameters such as focus, color, image, position, or other light characteristics. Multiparameter lighting fixtures are widely used in the lighting industry because they facilitate significant reductions in overall lighting system size and permit dynamic changes to the final lighting effect. Applications and events in which multiparameter lighting fixtures are used to great advantage include showrooms, television lighting, stage lighting, architectural lighting, live concerts, and theme parks. Illustrative multi-parameter lighting fixtures are described in the product brochure entitled "The High End Systems Product Line 2001" and are available from Barco Lighting Systems, Inc. of Austin, Tex.

Multiparameter lighting fixtures are commonly constructed with a lamp housing that may pan and tilt in relation to a base housing so that light projected from the lamp housing can be remotely positioned to project on the stage surface. Commonly a plurality of multiparameter lights are controlled by an operator from a central controller. The central controller is connected to communicate with the plurality of multiparameter lights via a communication system. U.S. Pat. No. 4,392,187 titled "Computer controlled lighting system having automatically variable position, color, intensity and beam divergence" to Bomhorst, which is incorporated herein by reference, disclosed a plurality of multiparameter lights and a central controller.

Typically, the lamp housing of a multiparameter light contains the optical components and the lamp. The lamp housing is rotatably mounted to a yoke that provides for a tilting action of the lamp housing in relation to the yoke. The lamp housing is tilted in relation to the yoke by a motor actuator system that provides remote control of the tilting action by the central controller. The yoke is rotatably connected to the base housing that provides for a panning action of the yoke in relation to the base housing. The yoke is panned in relation to the base housing by a motor actuator system that provides remote control of the panning action by the central controller.

Multiparameter lights may be constructed with various light sources. U.S. Pat. No. 6,357,893 to Belliveau, incorporated by reference herein, discloses various multiparameter lighting devices that have been constructed using light emitting diodes (LEDs) as light sources. U.S. Pat. No. 6,357,893 to Belliveau discloses a multiparameter light constructed of a plurality of LEDs that can individually vary the intensity of the light sources of the same wavelength or color in relation to each other.

U.S. Pat. No. 7,887,217 to Belliveau, incorporated by reference herein, discloses a multiparameter theatre stage light that comprises a plurality of LEDs as the light source. The theatre light disclosed comprises a lamp housing in which is mounted a plurality of LEDs to project a graphical output. The lamp housing can pan and tilt to provide remote positioning of the lamp housing for projection of light in different locations on the stage.

In the prior art the use of multiparameter LED theatre lights is now wide spread. An example of the prior art is the Impression "120 RZ" product by German Light Products of GLP German Light Products Inc., 10945 Pendleton Street, Sun Valley, Calif. 91352.

The Impression "120 RZ" is comprised of a lamp housing containing a plurality of LEDs that projection light from the lamp housing all in the same direction. The Impression "120 RZ" also has an optical zoom parameter that allows the light emitted from the LEDs to zoom from a spot (10 degrees) to a flood (26 degrees).

There is a need to provide a more dynamic theatre light device where the light emitted from the LEDs can be directed to more than one location simultaneously on the projection surface by remote control. A theatre light that can direct multiple beams of light to multiple locations on the projection surface can have greater control of the light energy emitted by the LEDs including changing the pattern and distribution of the projected light.

SUMMARY OF THE INVENTION

A novel theatre light apparatus is disclosed. The theatre light of one or more embodiments of the present invention incorporates a plurality of light emitting modules contained within a lamp housing each having a remotely controllable pan and tilt axis. The theatre light apparatus is also capable of remotely positioning the lamp housing containing the plurality of light emitting modules.

In at least one embodiment, a theatre lighting apparatus is provided comprising: a base, and a lamp housing. The lamp housing may be remotely positioned in relation to the base housing by a motor. The lamp housing may be comprised of a plurality of light emitting devices. The plurality of light emitting devices may include a first light emitting device which is individually remotely positionable to project a first light in a first direction, a second light emitting device which is individually remotely positionable to project a second light in a second direction, and a third light emitting device which is individually remotely positionable to project a third light in a third direction. The first direction, the second direction, and the third direction may be different from each other.

The first light emitting device may be comprised of a first plurality of light sources. The first plurality of light sources may be multicolored. Each of the first light emitting device, the second light emitting device, and the third light emitting device may emit light of a different color from each of the other of the first light emitting device, the second light emitting device, and the third light emitting device. Each of the first light emitting device, the second light emitting device, and the third light emitting device may emit light of a different intensity from each of the other of the first light emitting device, the second light emitting device, and the third light emitting device.

The theatre light apparatus may further include a computer or electronic memory. The computer memory may have stored therein a plurality of axis values, at least one axis value for each of the plurality of light emitting devices.

In another embodiment, a theatre lighting apparatus is provided comprising a base, a lamp housing, and a master pan and tilt device for remotely positioning the lamp housing in relation to the base. The lamp housing may be comprised of a plurality of light emitting modules. Each of the plurality of light emitting modules may be comprised of a module pan and tilt device for remotely directing light emitted by each of the plurality of light emitting modules to a plurality of locations on a projection surface. The theatre lighting apparatus may further include a coplanar optimization system. The theatre lighting apparatus may further include a user input device, wherein the coplanar optimization system is operated by a user operating the user input device.

In another embodiment a theatre lighting apparatus is provided including a base housing, a lamp housing, and a computer memory, wherein the lamp housing is remotely positioned in relation to the base, and wherein the lamp housing comprises a plurality of remotely positionable light emitting modules. The plurality of remotely positionable light emitting modules may include a first light emitting module, and a second light emitting module. The first light emitting module may be configured to be remotely positioned to a first set of coordinates to project a first light on to a projection surface to a first location. The second light emitting module may be configured to be remotely positioned to a second set of coordinates to project a second light on to a projection surface to a second location. The computer memory may have stored therein the first set of coordinates and the second set of coordinates. The first light emitting module and the second light emitting module may be substantially in a coplanar relationship. The theatre lighting apparatus may further include a user input panel. The first set of coordinates and the second set of coordinates may be selected by a user operating the input panel, and thereafter stored in the computer memory.

The theatre lighting apparatus may further include a communications port. The first set of coordinates and the second set of coordinates may be selected by a user operating a theatrical controller that communicates commands to the communications port. The computer memory may have stored therein a plurality of first axis values, at least one first axis value for each of the plurality of light emitting modules. The plurality of first axis values may be stored in the computer memory as a first preset. The computer memory may have stored therein a plurality of second axis values, at least one second axis value for each of the plurality of light emitting modules. The plurality of second axis values may be stored in the computer memory as a second preset. The first plurality of axis values and the second plurality of axis values may be different.

DETAILED DESCRIPTION OF THE DRAWINGS

Figure 1:
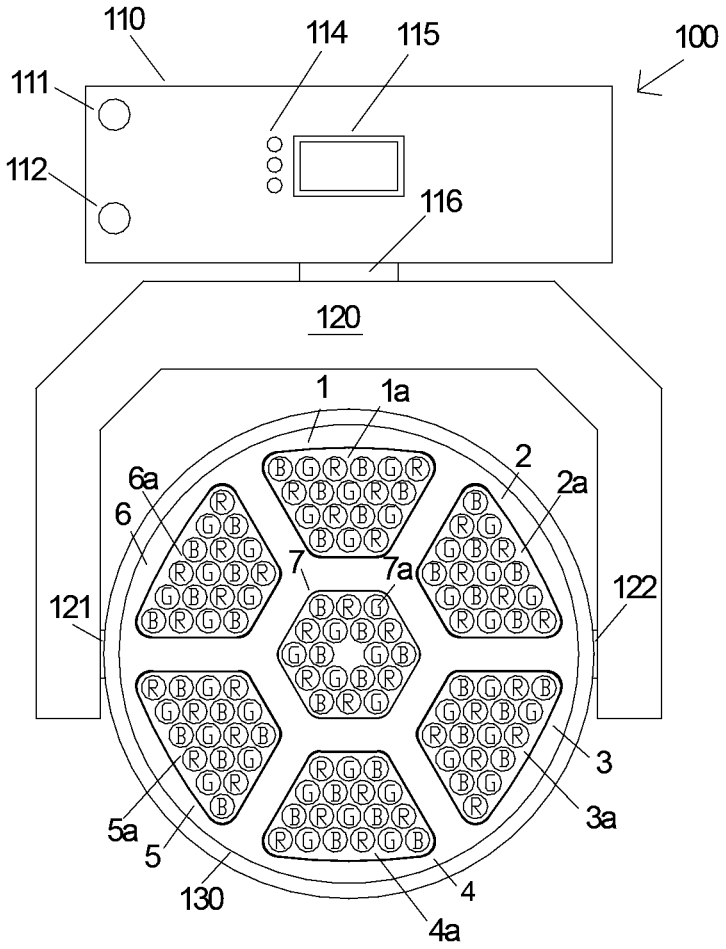
FIG. 1 shows a theatre light in accordance with an embodiment of the present invention in planar view.

FIG. 1 shows a theatre light 100 of an embodiment of the present invention in planar view. The theatre light 100 includes a lamp housing 130 and a base housing 110. The multiparameter light 100 is capable of remotely panning and tilting the lamp housing 130 in relation to the base housing 110. The lamp housing 130 is mounted by bearing assemblies 121 and 122 so that the lamp housing 130 can tilt in relation to a yoke 120. The yoke 120 can pan in relation to the base housing 110 by means of a bearing 116. The lamp housing 130 is remotely tilted in relation to the base housing 110 by a first motor actuator not shown for simplicity. The yoke 120 is remotely panned in relation to the base housing 110 by a second motor actuator not shown for simplicity. That parameter of the pan and tilt of the lamp housing 130 in relation to the base housing 110 for theatre light 100 of FIG. 1 is referred to as pan and tilt.

The lamp housing 130 is comprised of seven light emitting modules 1, 2, 3, 4, 5, 6, and 7 each containing a plurality light emitting diodes (LEDS) 1*a*, 2*a*, 3*a*, 4*a*, 5*a*, 6*a* and 7*a* that emit light to illuminate a stage or projection surface. The modules 1, 2, 3, 4, 5, and 6 are remotely positionable modules. Module 7 of FIG. 1 is a stationary center module. Each of the LEDs of 1*a*-7*a* is shown as either R=red, G=green, or B=blue but the LEDs of 1*a*-7*a* can be any color combination and may include white LEDs. Other light sources can be substituted for LEDs 1*a*-7*a*, but LEDs are preferred. The light sources for each module of modules 1, 2, 3, 4, 5, 6 and 7 can be a plurality or each module of modules 1-7, can have a single light source.

Figure 2:
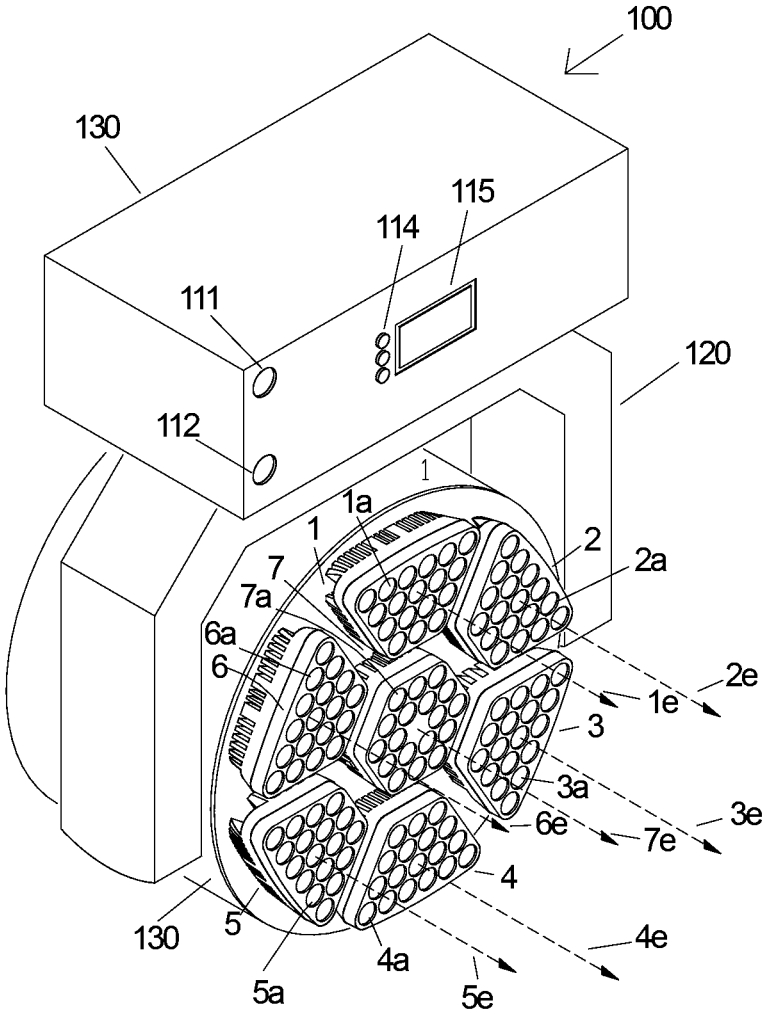
FIG. 2 shows the theatre light of FIG. 1 in a forty-five degree view emitting light with a plurality of light emitting diode modules in a planar orientation.

The base housing 100 also contains the electronics for remotely positioning the base housing 110 in relation to the lamp housing 130 and for remotely positioning modules 1, 2, 3, 4, 5, and 6. The base housing 100 also contains a communications input connector 111 and a communications output connector 112. Input keys 114 are operated in conjunction with a graphic display 115 to allow a user to set different functions, test out the theatre light operation and optimize the planar alignment of the modules 1, 2, 3, 4, 5, and 6. Modules 1, 2, 3, 4, 5, and 6 can remotely and individually pan and tilt their emitted light and the master pan and tilt system can also pan and tilt the lamp housing 130 with respect to the base housing 110, which effectively pans and tilts all the modules 1, 2, 3, 4, 5, 6, and 7 simultaneously FIG. 2 shows the theatre light 100 of FIG. 1 in a forty-five degree orientation. The lamp housing 130 is comprised of a plurality light emitting diodes (LEDS) 1*a*, 2*a*, 3*a*, 4*a*, 5*a*, 6*a* and 7*a* that emit light to illuminate a stage or projection surface. The LEDs 1*a*, 2*a*, 3*a*, 4*a*, 5*a*, 6*a* and 7*a* are located within six remotely positionable modules 1, 2, 3, 4, 5, 6. Module 7 of FIG. 1 is a stationary center module. All seven light emitting modules 1, 2, 3, 4, 5, 6, and 7 are shown in a coplanar position in FIG. 2. The light emitted by the LEDs 1*a* of module 1 in FIG. 2 is shown by the direction of arrow 1*e*. The light emitted by the LEDs 2*a* of module 2 in FIG. 2 is shown by the direction of arrow 2*e*. The light emitted by the LEDs 3*a* of module 3 in FIG. 2 is shown by the direction of arrow 3*e*. The light emitted by the LEDs 4*a* of module 4 in FIG. 2 is shown by the direction of arrow 4*e*. The light emitted by the LEDs 5*a* of module 5 in FIG. 2 is shown by the direction of arrow 5*e*. The light emitted by the LEDs 6*a* of module 6 in FIG. 2 is shown by the direction of arrow 6*e*. The light emitted by the LEDs 5*a* of module 5 is shown by the direction of arrow 5*e*. The light emitted by the LEDs 7*a* of module 7 in FIG. 2 is shown by the direction of arrow 7*e*. In FIG. 2 the light directions as shown by arrows 1*e*, 2*e*, 3*e*, 4*e*, 5*e*, 6*e* and 7*e* are essentially parallel to one another.

Figure 3:
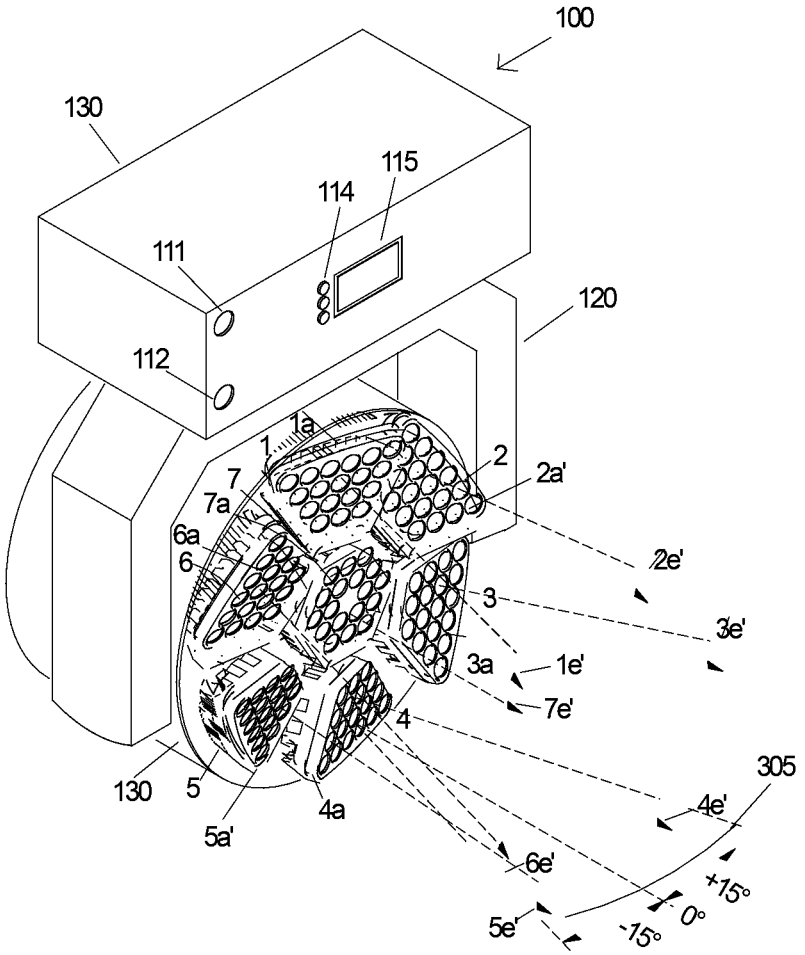
FIG. 3 shows the theatre light of FIG. 1 in a forty-five degree view with the plurality of light emitting diode modules panned in a first state.

FIG. 3 shows the theatre light 100 in the same forty-five degree orientation as in FIG. 2. The lamp housing 130 is comprised of a plurality light emitting diodes (LEDS) 1*a*, 2*a*, 3*a*, 4*a*, 5*a*, 6*a* and 7*a* that emit light to illuminate a stage or projection surface. The LEDs 1*a*, 2*a*, 3*a*, 4*a*, 5*a*, 6*a* and 7*a* are located within six remotely positionable modules 1, 2, 3, 4, 5, 6. Module 7 shown in FIG. 3 is a stationary center module.

Light emitting modules 1, 2, 3, 4, 5 and 6 are shown in FIG. 3 in a state with their pan axis panned plus fifteen degrees. An illustration 305 in FIG. 3 shows the range of pan for module 4, however the other modules 1, 2, 3, 5 and 6 also have this pan axis range, in at least one embodiment. The illustration 305 shows a maximum negative panning of negative fifteen degrees) (−15°), a zero degree or no panning (0°) and a positive panning of positive fifteen degrees (−15°) The light emitted by the LEDs 1*a* of module 1 in FIG. 3 is shown by the direction of arrow 1*e*'. The light emitted by the LEDs 2*a* of module 2 in FIG. 3 is shown by the direction of arrow 2*e*'. The light emitted by the LEDs 3*a* of module 3 in FIG. 3 is shown by the direction of arrow 3*e*'. The light emitted by the LEDs 4*a* of module 4 in FIG. 3 is shown by the direction of arrow 4*e*'. The light emitted by the LEDs 5*a* of module 5 in FIG. 3 is shown by the direction of arrow 5*e*'. The light emitted by the LEDs 6*a* of module 6 in FIG. 3 is shown by the direction of arrow 6*e*'. The light emitted by the LEDs 7*a* of module 7 is shown by the direction of arrow 7*e*'. Although the modules 1, 2, 3, 4, 5, and 6 in FIG. 3 are shown all panning towards positive axis for simplicity any of the modules 1, 2, 3, 4, 5, and 6 can pan separately various amounts up to plus or minus fifteen degrees. FIG. 3 shows the modules 1-6 only panning (and not tilting) for simplicity but any of the modules 1, 2, 3, 4, 5 and 6 can independently pan and tilt simultaneously and independently.

Figure 4:
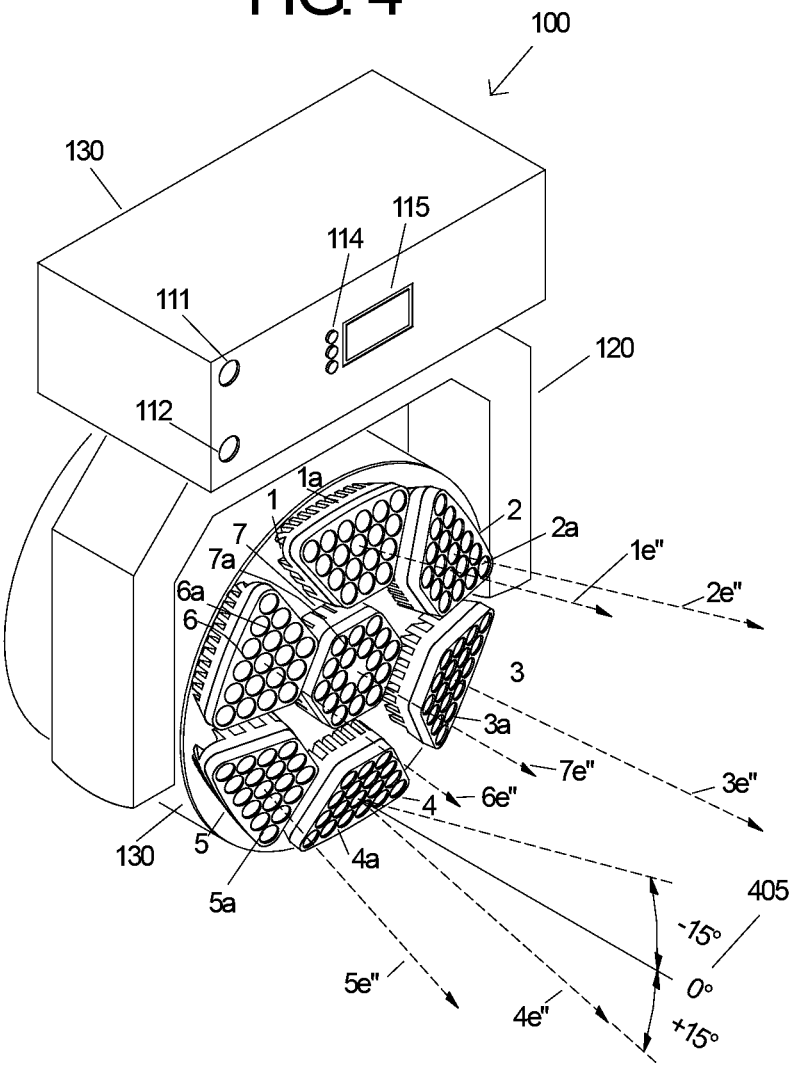
FIG. 4 shows the theatre light of FIG. 1 in a forty-five degree view with the plurality of light emitting diode modules tilted in the first state.

FIG. 4 shows the theatre light 100 in the same forty-five degree orientation as FIG. 2. The lamp housing 130 is comprised of a plurality light emitting diodes (LEDS) 1*a*, 2*a*, 3*a*, 4*a*, 5*a*, 6*a* and 7*a* that emit light to illuminate a stage or projection surface. The LEDs 1*a*, 2*a*, 3*a*, 4*a*, 5*a*, 6*a* and 7*a* are located within six remotely positionable modules 1, 2, 3, 4, 5, and 6, respectively. Module 7 of FIG. 1 is a stationary center module.

Light emitting modules 1, 2, 3, 4, 5 and 6 are shown in FIG. 4 in a state with their tilt axis tilted plus fifteen degrees. An illustration 405 shows the range of tilt for module 4 however the other modules 1, 2, 3, 5 and 6 also have this tilt axis range. The light emitted by the LEDs 1*a* of module 1 in the FIG. 4 state is shown by the direction of arrow 1*e*". The light emitted by the LEDs 2*a* of module 2 in the FIG. 4 state is shown by the direction of arrow 2*e*". The light emitted by the LEDs 3*a* of module 3 in the FIG. 4 state is shown by the direction of arrow 3*e*". The light emitted by the LEDs 4*a* of module 4 in the FIG. 4 state is shown by the direction of arrow 4*e*". The light emitted by the LEDs 5*a* of module 5 in the FIG. 4 state is shown by the direction of arrow 5*e*". The light emitted by the LEDs 6*a* of module 6 in the FIG. 4 state is shown by the direction of arrow 6*e*". The light emitted by the LEDs 7*a* of module 7 in the FIG. 4 state is shown by the direction of arrow 7*e*". Although the modules 1, 2, 3, 4, 5, and 6 in FIG. 4 are shown all tilting in the same positive axis for simplicity any of the modules 1, 2, 3, 4, 5, and 6 can tilt separately various amounts up to maximums of plus or minus fifteen degrees. FIG. 4 shows the modules 1-6 only tilting for simplicity but each of the modules 1, 2, 3, 4, 5 and 6 can independently pan and tilt simultaneously and independently.

Figure 5:
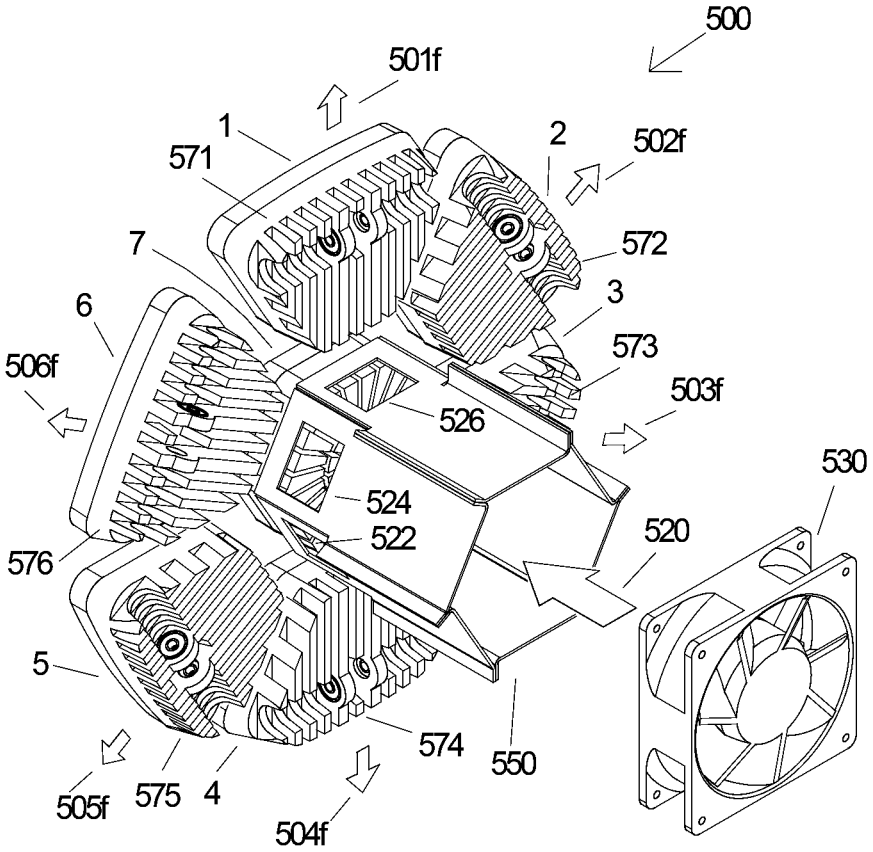
FIG. 5 shows a cooling system of the theatre light of FIG. 1.

FIG. 5 shows a ventilation system 500 for the theatre light 100 of FIG. 1. A typically one hundred and twenty millimeter (mm) fan 530 creates air flow in the direction of an arrow 520 through an air duct 550 that directs air downward on the module 7 and exits through an air port 524. The air that exits through air port 524 flows air across a heat sink 576 of the module 6 and exits in the direction of an arrow 506*f*. Air exiting from an air port 526 flows across a heat sink 571 of the module 1 and the air exits from heat sink 571 in the direction of an arrow 501*f*. Air exiting from an air port 522 exiting flows across a heat sink 575 of the module 5 and the air from the heat sink 575 exits in the direction of an arrow 505*f*. An arrow 502*f* shows air exiting from the heat sink 572 of the module 2 (the air port for the heat sink 572 is not shown for simplicity). An arrow 503*f* shows air exiting from the heat sink 573 of the module 3 (the air port for the heat sink 573 is not shown for simplicity). An arrow 504*f* shows air exiting from the heat sink 574 of the module 4 (the air port for the heat sink 574 is not shown for simplicity).

Figure 6A:
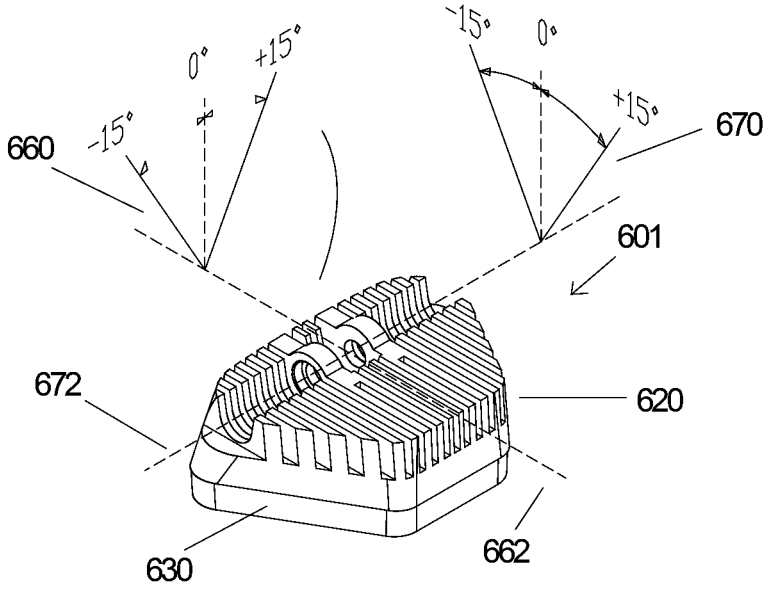
FIG. 6A and FIG. 6B show perspective views of a first light emitting diode module of the plurality of light emitting diode modules of the theatre of FIG. 1.
Figure 6B:
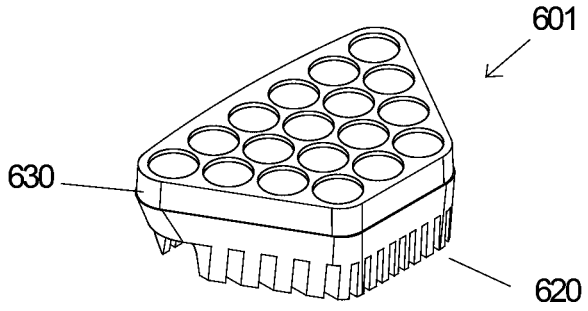

FIG. 6A and FIG. 6B show perspective views of a module 601. Each of the modules 1, 2, 3, 4, 5, and 6 of FIG. 1, may be the same as the module 601. The diagram diagrams of FIG. 6A and FIG. 6B are used to show closeup views of a possible module of any of the modules 1-6. The module 601 may include a heat sink 602 and an LED housing 630 shown in FIG. 6A and FIG. 6B. To keep the lamp housing 130 of the theatre light 100 of FIG. 1 compact the pivoting points for the pan axis and tilt axis for the module 601 should be close to the intersection of the heat sink 602 and the LED housing 630. The panning axis pivot point of the module 601 is shown by dotted line 662. An illustration 660 of the panning range of the module 601 with respect to the lamp housing 130 is shown. The tilting axis pivot point is shown by dotted line 672. An illustration 670 of the panning range of the module 601 with respect to the lamp housing 130 is shown. Although a range of plus and minus fifteen degrees for the panning axis and plus and minus fifteen degrees for the tilting axis is shown the range can be increased or decreased as desired however to prevent collisions and to make the lamp housing 130 of the theatre light 100 compact, the pivot points of the modules 1-6 should be located close to the intersection of the heat sink 602 and the LED housing 630.

Figure 7:
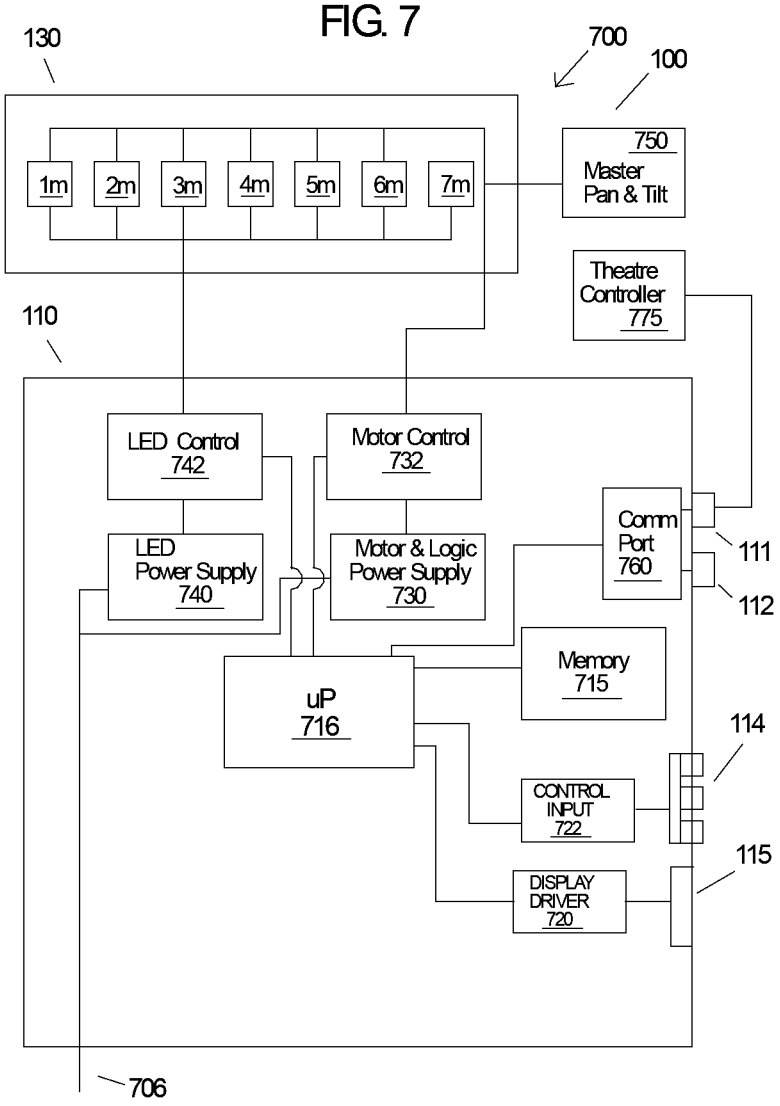
FIG. 7 shows an electrical diagram of the theatre light of FIG. 1.

FIG. 7 shows an electrical diagram 700 of the theatre light 100 of FIG. 1. The base housing 110 has a means for accepting external power 706, which may be an electrical cord. External power is routed to the motor and logic supply 730 and the LED power supply 740. A theatrical controller 775 is shown connected to the communications input connector 111. The theatre light 100 can be controlled to operate with the USITT (United States Institute of Theatre Technology) DMX 512 protocol. The USITT DMX protocol, as known in the art, is comprised of 512 control channels with each channel having two hundred and fifty-six selectable values. Other communications protocols can be used. The communication connector 111 routes communication commands to a communications port 760 and sends the communication commands to a computer processor or micro processor 719 where the commands are operated on by operating software stored in the memory or computer memory 715. The computer processor 716 can also operate on commands received by the control input 722 that is connected to user input keys 114 located on the electronics housing 110. Visual confirmation of commands and input direction to the user is provided by the processor 716 working in conjunction with a display driver 720 and a user display 115 located on the electronics housing 110.

The processor 716 provides instructions based upon received command from the communications port 760 to the motor control 732. The motor control 732 provides power and control of the motors of module devices 1*m*, 2*m*, 3*m*, 4*m*, 5*m*, and 6*m*. that operate the pan and tilt axis of modules 1, 2, 3, 4, 5, and 6, respectively. Each motor device of devices 1*m*-6*m* has their own separate gimbal mechanism (or referred to as a pan and tilt apparatus) that operates with a pan and tilt motor (not shown for simplicity.) Thus each motor device of motor devices 1*m*-6*m* has two motors, one for panning and one for tilting, for a total of twelve motors, two for each of modules 1-6. Each of the twelve motors (two for each module) can be remotely controlled to adjust the pan and tilt axis of each module of modules 1-6, separately. The motor control 732 also supplies power and controls the master pan and tilt motors 750 that position the lamp housing 130 in relation to the base housing 110. In at least one embodiment, the component labeled 7*m* is the same module as module 1 of theatre light 100 of FIG. 1 and is a stationary module so the motor control 732 of FIG. 7 does not need to supply power and control to the module 7*m*.

The processor 716 provides instructions based upon received commands from the communications port 760 to the LED control 742. The LED control 742 provides power and control of the LEDs 1*a*, 2*a*, 3*a*, 4*a*, 5*a*, 6*a*, and 7*a* of the modules 1, 2, 3, 4, 5, 6 and 7, respectively. The processor 716 is configured to be able to vary, through the LED control 742, red light intensity of each LED of each of modules 1-7 independently of the other LEDs of the other modules of modules 1-7. The processor 716 is configured to be able to vary, through the LED control 742, green light intensity of each LED of each of modules 1-7 independently of the other LEDs of the other modules of modules 1-7. The processor 716 is configured to be able to vary, through the LED control 742, blue light intensity of each LED of each of modules 1-7 independently of the other LEDs of the other modules of modules 1-7. The processor 716 is configured to be able to vary, through the LED control 742, partial spectrum or full spectrum (such as white light) intensities of each LED of each of modules 1-7 independently of the other LEDs of the other modules of modules 1-7.

The theatre lights of the prior art have one pan and tilt parameter wherein the lamp housing is positioned remotely relative to the base housing by panning and tilting. The theatre light of at least one embodiment of the present invention has a master pan and a master tilt parameter where the lamp housing 130 is positioned relative to the base housing 110 by panning and tilting and additionally, a module pan and a module tilt parameter for each of the modules 1, 2, 3, 4, 5, and 6. Thus for theatre light 100, there are six module pan parameters (for modules 1-6 versus lamp housing 130), six module tilt parameters (for modules 1-6 versus lamp housing 130), one master pan parameter (for lamp housing 130 versus base housing 110), and one master tilt parameter (for lamp housing 130 versus base housing 110).

This means parameters of pan and tilt along with the variable parameters of control of the LED intensities of the LEDs of modules 1-7 and color for each module of modules 107 bring a lot of complexity when the theatre light 100 of FIG. 1 is controlled by a user of the theatrical controller or theatre controller 775. In accordance with an embodiment of the present invention, the memory 715 of FIG. 7 of the theatre light 100, may be pre programmed or have stored therein computer software for a plurality of preset functions. The preset functions can contain panning and tilting axis values stored in the memory 715 wherein the processor 716 of the theatre light 100 of FIG. 1 can implement the present functions and/or values stored in the memory 715 by varying the pan and tilt axis for modules 1, 2, 3, 4, 5 and 6 to a programmed routine stored in the memory 715 of FIG. 7. A user of the theatre controller 775 of FIG. 7 can send preset control commands to the theatre light 100 where it is received by the communication port 760 and acted upon by the processor 716. The processor 716 in conjunction with the operating software and preset axis values stored in the memory 715 can send control signals to vary the pan and tilt axis of the modules 1, 2, 3, 4, 5 and 6 of the theatre light 100 of FIG. 1. Each preset stored in the memory 715 can contain control information to independently vary the pan and tilt axis of modules 1, 2, 3, 4, 5 and 6. The memory 715 contains axis values for a plurality of pan and tilt modules. A preset or preset value stored in the memory 715 can also contain separate color and intensity information for the modules 1, 2, 3, 4, 5 and 6, which can be implemented by the processor 716 to control the modules 1-6.

Because of mechanical tolerances between the gimbal mechanisms of modules 1, 2, 3, 4, 5, and 6 the zero degree reference from each module of modules 1-6, may vary. It has been deemed desirable to have a user input system for alignment of the six modules of modules 1-6 to optimize the coplanar relationship between them. In at least one embodiment, the processor 716 is programmed by software stored in computer memory 715 to respond to a user input through the input of the user keypad 114 of FIG. 7 to cause selection of a coplanar mode. When the coplanar mode is selected the user, through keypad 114, the user can adjust the coplanar relationship of each module of modules 106. For example the user in the coplanar mode can select module 1 of FIG. 2 and make an adjustment with the theatre light 100 projecting on a screen at a distance so that the light emitted by module 1 is in alignment with the light projected by module 7 (the fixed module). When the user is satisfied with the coplanar adjustment the user can cause the processor 716 to record the coplanar coordinates in the memory 715, through use of the keypad 114. The processor 716 is programmed by software stored in the memory 715 to allow the user to continue to adjust all six modules for being coplanar in relation to module 7 of FIG. 2, through keypad 114, and to store all coplanar coordinates in the memory 715. In this way later operation of the theatre light 100 by position commands received by the theatrical controller 775 will be more accurate and the modules 1-6 will have better position tracking relative to one to another.

In one or more embodiments, it the theatre light 100 is also configured and it can also be desirable for the operator of the theatre controller 775 to make a coplanar optimization of the theatre light 100 from the theatre controller 775. Therefore the theatre light 100 of one or more embodiments of the present invention can be put into a coplanar optimization mode by commands sent by the theatre controller 775, which are received through the communications port 760 by the processor 716, and acted on by the processor 716 in accordance with computer software stored in the memory 715 to put the theatre light into coplanar optimization mode. This can be useful to the operator because many time theatrical lights, such as one or more of lights identical to light 100, may be hanging in hard to reach locations and it can be useful for an operator of the theatre controller 775 to adjust the coplanar optimization for all the modules 1, 2, 3, 4, 5, and 6 in relation to the fixed module 7 from the operator's remote location.

Figure 8:
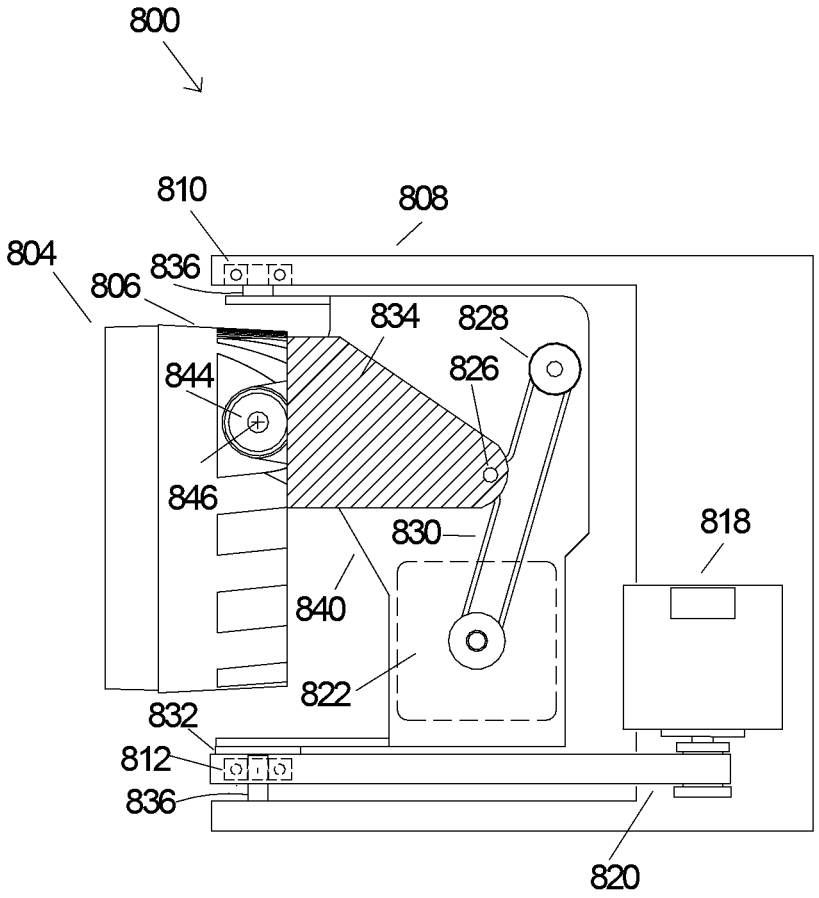
FIG. 8 is a diagram which helps describe one method of articulating the first light emitting diode module of the plurality of light emitting diode modules of the theatre light of FIG. 1.

FIG. 8 illustrates a diagram 800 for an articulating module 804 that can be the same as the module 4 of FIG. 1. The module 804 has a heat sink 806. The heat sink 806 can rotate round a shaft 846 with the aid of bearing 844 allowing the module 804 to articulate in the tilt axis. A motor pulley 822 is fixed to a motor mounting plate 840 and a motor pulley 828 drives a belt 830 that is connected to a module mount 834 at connection point 826. The belt 830 also rotates around motor pulley 828 and causes the module mount 834 and the articulating module 804 to rotate about the shaft 846.

The motor mounting plate 840 is attached to a pulley 832 that can be driven to rotate by belt 820 when the motor pulley 818 operates. The pulley 832 is smoothly rotated on a bearing 812 that can turn about shaft 836 mounted to yoke 808. The yoke 808 also has opposite bearing 810 affixed to the yoke 808. A shaft 836 is fixed to the motor mounting plate 840. In this way the motor mounting plate 840 can be driven by motor pulley 818 to swing inside of the yoke 808. This causes a panning action of the articulating module 804.

Figure 9A:
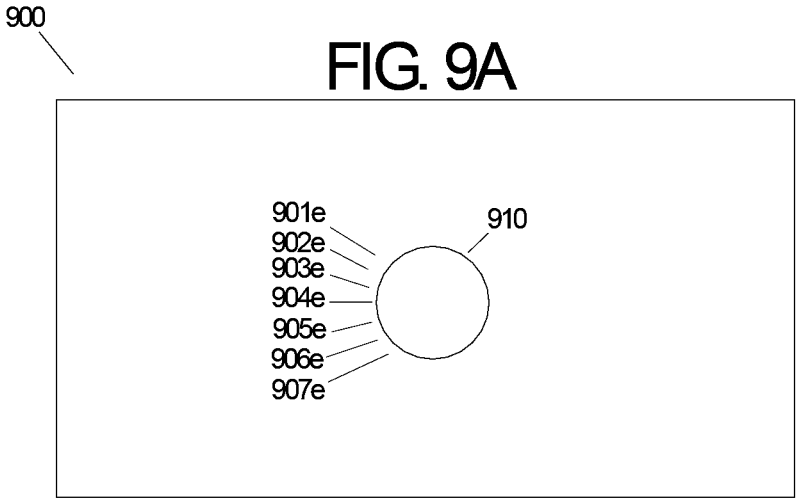
FIG. 9A shows the projected light on the projection surface from the theatre light of FIG. 1 in the first state.

FIG. 9A shows a projection surface 900 that may be a stage. There are seven spots of projected light 901*e*, 902*e*, 903*e*, 904*e*, 905*e*, 906*e*, and 907*e* that are superimposed to produce a single spot of light 910 because the theatre light 100 of FIG. 1 (not shown for simplicity) is operating in planar mode and emitting light from modules 1, 2, 3, 4, 5, 6, and 7 of theatre light 100 of FIG. 1. The light spots 901*e*, 902*e*, 903*e*, 904*e*, 905*e*, 906*e*, and 907*e* may be any color or intensity to create the light spot 910.

For FIGS. 9A, 9B, 9C and 9D the projected light 901*e* is the projected light emitted by the module 1 of theatre light 100 of FIG. 1. For FIGS. 9A, 9B, 9C and 9D the projected light 902*e* is the projected light emitted by the module 2 of theatre light 100 of FIG. 1. For FIGS. 9A, 9B, 9C and 9D the projected light 903*e* is the projected light emitted by the module 3 of theatre light 100 of FIG. 1. For FIGS. 9A, 9B, 9C and 9D the projected light 904*e* is the projected light emitted by the module 4 of theatre light 100 of FIG. 1. For FIGS. 9A, 9B, 9C and 9D the projected light 905*e* is the projected light emitted by the module 5 of theatre light 100 of FIG. 1. For FIGS. 9A, 9B, 9C and 9D the projected light 906*e* is the projected light emitted by the module 6 of theatre light 100 of FIG. 1. For FIGS. 9A, 9B, 9C and 9D the projected light 907*e* is the projected light emitted by the module 7 of theatre light 100 of FIG. 1.

Figure 9B:
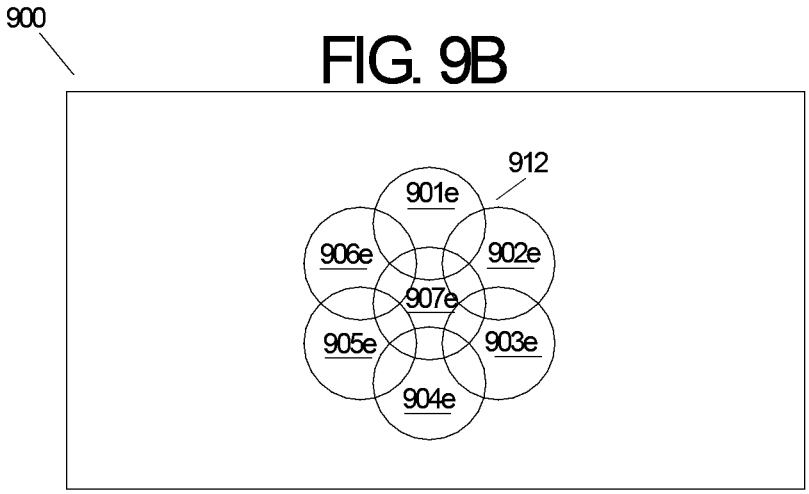
FIG. 9B shows the projected light on the projection surface from the theatre light of FIG. 1 in a second state.

FIG. 9B shows a projection surface 900 that may be a stage. There are seven spots of projected light 901*e*, 902*e*, 903*e*, 904*e*, 905*e*, 906*e*, and 907*e* that are producing an overall combined region or pattern of light 912 (referred to as zoomed out) because the theatre light 100 of FIG. 1 (not shown for simplicity) is operating to direct the light from modules 1, 2, 3, 4, 5, 6, and 7 in a non-planar mode to form the combined region or pattern of light 912. The light spots 901*e*, 902*e*, 903*e*, 904*e*, 905*e*, 906*e*, and 907*e* may be any color or intensity to create the combined region or pattern of light 912.

Figure 9C:
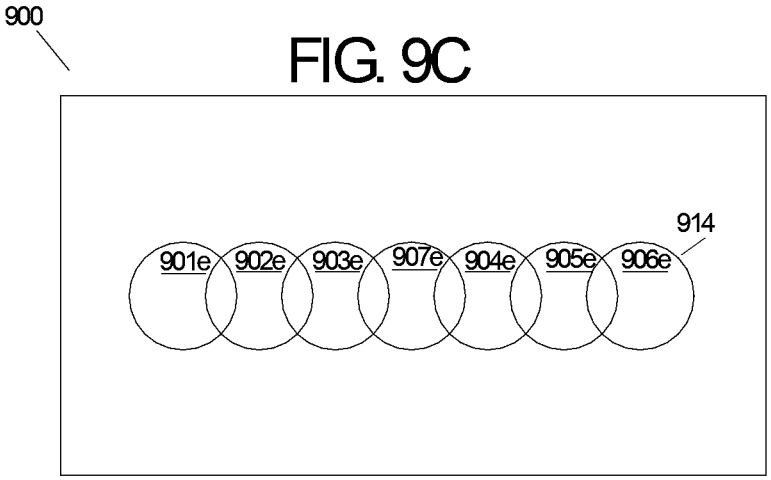
FIG. 9C shows the projected light on the projection surface from the theatre light of FIG. 1 in a third state.

FIG. 9C shows the projection surface 900 that may be a stage. The seven spots of projected light 901*e*, 902*e*, 903*e*, 904*e*, 905*e*, 906*e*, and 907*e* are shown, but they are placed in different locations which respect to one another compared to FIG. 9A and FIG. 9B. In the configuration of FIG. 9*c* the combination of lights 901*e*-907*e* produce a linear shaped combined region or pattern of light 1014 because the theatre light 100 of FIG. 1 (not shown for simplicity) is operating to direct the light from modules 1, 2, 3, 4, 5, 6, and 7 in a non-planar mode to form the linear shaped combined region or pattern of light 914. The sports of projected light 901*e*, 902*e*, 903*e*, 904*e*, 905*e*, 906*e*, and 907*e* may be any color or intensity to create the linear shaped combined region or pattern of light 914.

Figure 9D:
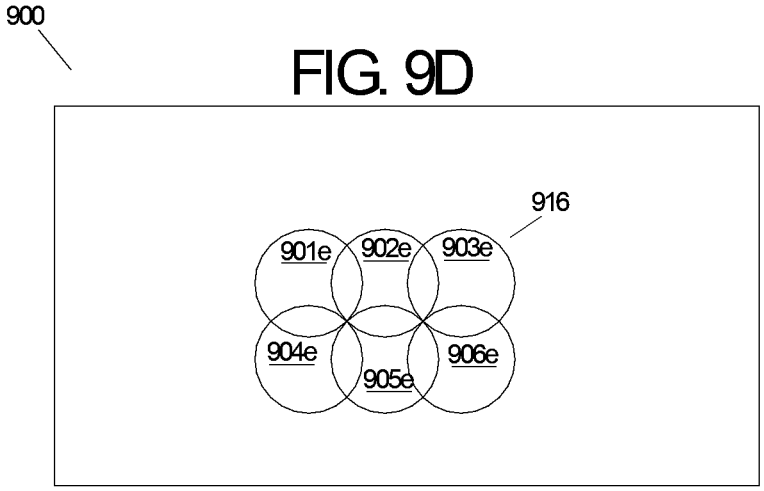
FIG. 9D shows the projected light on the projection surface from the theatre light of FIG. 1 in a fourth state.

FIG. 9D shows the projection surface 900 (show as same size and shape in all FIGS. 9A-9B) that may be a stage. FIG. 9C shows the six spots of projected light 901*e*, 902*e*, 903*e*, 904*e*, 905*e*, and 906*e*, but in a different configuration from FIGS. 9A, 9B, and 9C, that are producing a rectangular shaped combined region or pattern of light 916 because the theatre light 100 of FIG. 1 (not shown for simplicity) is operating to direct the light from modules 1, 2, 3, 4, 5 and 6 in a non-planar mode to form the rectangular spot pattern 916. Module 7 of the theatre light 100 of FIG. 1 has been controlled to not emit light to create the rectangular light pattern 916. The light spots 901*e*, 902*e*, 903*e*, 904*e*, 905*e*, 906*e*, and 907*e* may be any color or intensity to create the rectangular light spot 916.

Infinite color variations, light intensity and lighting projection patterns can be achieved with the operation of the theatre light 100 of FIG. 1 operating by a user of the theatre controller 775

Although the theatre light 100 of FIG. 1 is comprised of six modules that each have separate pan, tilt, color and intensity control as also influenced by a master pan and tilt system, more or less modules can be applied in one or more alternative embodiments of the present invention. Additionally module 7 could also be equipped with a remote pan and or tilt functions.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

We claim:

1. A theatre lighting apparatus comprising:

a base housing, and a lamp housing;

wherein the lamp housing is remotely positioned in relation to the base housing by a motor;

wherein the lamp housing is comprised of a plurality of light emitting devices;

wherein the plurality of light emitting devices include a first light emitting device which is individually remotely positionable by individually panning and tilting the first light emitting device to project a first light in a first direction;

wherein the plurality of light emitting devices include a second light emitting device which is individually remotely positionable by individually panning and tilting the second light emitting device to project a second light in a second direction;

wherein the plurality of light emitting devices include a third light emitting device which is individually remotely positionable by individually panning and tilting the third light emitting device to project a third light in a third direction;

wherein the plurality of light emitting devices include a fourth light emitting device which is individually remotely positionable by individually panning and tilting the fourth light emitting device to project a fourth light in a fourth direction;

wherein the first, the second, the third, and the fourth light emitting devices are configured so that the first direction, the second direction, the third direction and the fourth direction can be sequentially aligned to produce a linear shaped region.

2. The theatre lighting apparatus of claim 1 wherein the first light emitting device is comprised of a first plurality of light sources.

3. The theatre lighting apparatus of claim 2 wherein the first plurality of light sources are multicolored.

4. The theatre lighting apparatus of claim 1 wherein each of the first light emitting device, the second light emitting device, and the third light emitting device emits light of a different color from each of the other of the first light emitting device, the second light emitting device, and the third light emitting device.

5. The theatre light apparatus of claim 1 wherein each of the first light emitting device, the second light emitting device, and the third light emitting device emits light of a different intensity from each of the other of the first light emitting device, the second light emitting device, and the third light emitting device.

6. The theatre light apparatus of claim 1 further comprising a computer memory;

wherein the computer memory has stored therein a plurality of axis values, at least one axis value for each of the plurality of light emitting devices.

7. The theatre lighting apparatus of claim 1 wherein wherein the lamp housing is remotely positioned in relation to the base housing by the motor independently of the individual panning and tilting the first, second, third, and fourth light emitting devices;

wherein the first light emitting device is individually remotely positionable by individually panning and tilting the first light emitting device, independently of the remote positioning of the lamp housing in relation to the base housing, and independently of the individual panning and tilting of the second, third, and fourth light emitting devices;

wherein the second light emitting device is individually remotely positionable by individually panning and tilting the second light emitting device, independently of the remote positioning of the lamp housing in relation to the base housing, and independently of the individual panning and tilting of the first, third, and fourth light emitting devices;

wherein the third light emitting device is individually remotely positionable by individually panning and tilting the third light emitting device, independently of the remote positioning of the lamp housing in relation to the base housing, and independently of the individual panning and tilting the first, second, and fourth light emitting devices; and wherein the fourth light emitting device is individually remotely positionable by individually panning and tilting the third light emitting device, independently of the remote positioning of the lamp housing in relation to the base housing, and independently of the individual panning and tilting the first, second, and third light emitting devices.

8. A theatre lighting apparatus comprising a base, a lamp housing, a master pan and tilt device for remotely positioning the lamp housing in relation to the base;

wherein the lamp housing comprises a plurality of light emitting modules;

wherein each of the plurality of light emitting modules comprises a module pan and tilt device for remotely directing light emitted by each of the plurality of light emitting modules to a plurality of locations on a projection surface.

9. The theatre lighting apparatus of claim 8 further comprising a coplanar optimization system.

10. The theatre lighting apparatus of claim 9 further comprising a user input device;

wherein the coplanar optimization system is operated by a user operating the user input device.

11. The theatre lighting apparatus of claim 8 wherein the master pan and tilt device is configured to remotely position the lamp housing in relation to the base, independently of all of the module pan and tilt devices; and each of the module pan and tilt devices is configured to remotely pan and tilt its corresponding light emitting module of the plurality of light emitting modules independently of all of the other module pan and tilt devices and independently of the master pan and tilt device.

12. A theatre lighting apparatus comprising a base housing, a lamp housing, and a computer memory;

wherein the lamp housing is remotely positioned in relation to the base housing;

wherein the lamp housing comprises a plurality of remotely positionable light emitting modules;

wherein the plurality of remotely positionable light emitting modules includes a first light emitting module, and a second light emitting module;

wherein the first light emitting module is configured to be remotely positioned by individually panning and tilting the first light emitting module to a first set of coordinates to project a first light on to a projection surface to a first location;

wherein the second light emitting module is configured to be remotely positioned by individually panning and tilting the second light emitting module to a second set of coordinates to project a second light on to a projection surface to a second location;

wherein the computer memory has stored therein the first set of coordinates and the second set of coordinates; and wherein the first light emitting module and the second light emitting module are substantially in a coplanar relationship.

13. The theatre lighting apparatus of claim 12 further comprising a user input panel;

wherein the first set of coordinates and the second set of coordinates are selected by a user operating the input panel, and thereafter stored in the computer memory.

14. The theatre lighting apparatus of claim 12 further comprising a communications port;

wherein the first set of coordinates and the second set of coordinates are selected by a user operating a theatrical controller that communicates commands to the communications port.

15. The theatre lighting apparatus of claim 12 wherein the computer memory has stored therein a first plurality of location values, each of the first plurality of location values having an X and a Y value, at least one of the first plurality of location values for each of the plurality of light emitting modules;

wherein the first plurality of location values are stored in the computer memory as a first preset;

wherein the computer memory has stored therein a second plurality of location values, each of the second plurality of location values having an X and a Y value, at least one of the second plurality of location values for each of the plurality of light emitting modules;

wherein the second plurality of location values are stored in the computer memory as a second preset; and wherein the first plurality of location values and the second plurality of location values are different.

16. The theatre lighting apparatus of claim 12 wherein wherein the lamp housing is configured to be remotely positioned in relation to the base, independently of the remote positioning of the first light emitting diode module, and independently of the remote positioning of the second light emitting diode module;

wherein the first light emitting module is configured to be remotely positioned by individually panning and tilting the first light emitting module, independently of the remote positioning of the second light emitting diode module, and independently of the remote positioning of the lamp housing in relation to the base; and wherein the second light emitting module is configured to be remotely positioned by individually panning and tilting the second light emitting module, independently of the remote positioning of the first light emitting diode module, and independently of the remote positioning of the lamp housing in relation to the base.

17. A theatre lighting apparatus comprising:

a base housing;

a yoke;

and a lamp housing;

wherein the lamp housing is remotely positionable relative to the yoke by a first motor about a first tilt axis;

wherein the yoke is remotely positionable to the base housing by a second motor about a first pan axis;

wherein the lamp housing is comprised of a plurality of light emitting modules;

wherein each of the plurality of light emitting modules is comprised of a plurality of red, blue, and green light emitting diodes;

wherein each of the plurality of light emitting modules is independently remotely controllable and positionable about an individual pan axis and an individual tilt axis;

wherein a first light emitting module of the plurality of light emitting modules is comprised of a third motor for articulation of the first light emitting module with the lamp housing about the individual tilt axis for the first light emitting module and a fourth motor for articulation of the first light emitting module with the lamp housing about the individual pan axis for the first light emitting module;

wherein a second light emitting module of the plurality of light emitting modules is comprised of a fifth motor for articulation of the second light emitting module with the lamp housing about the individual tilt axis for the second light emitting module and a sixth motor for articulation of the second light emitting module with the lamp housing about the individual pan axis for the second light emitting module;

wherein the individual tilt axis for the first light emitting module, the individual pan axis for the first light emitting module, the individual tilt axis for the second light emitting module, and the individual pan axis for the second light emitting module are dependent upon the positioning of the lamp housing with respect to the yoke about the first tilt axis, and the positioning of the yoke with respect to the base housing about the first pan axis.

18. The theatre lighting apparatus of claim 17 wherein the lamp housing is remotely positionable relative to the yoke by the first motor about the first tilt axis, and the yoke is remotely positionable to the base housing by a second motor about the first pan axis, independently of the remote positioning of any of the plurality of light emitting diode modules; and wherein each of the plurality of light emitting modules is remotely controllable and positionable about its respective individual pan axis and individual tilt axis independently of any other of the plurality of light emitting diodes, and independently of the remote positioning of the lamp housing relative to the yoke, and the yoke relative to the base housing.

19. A theatre lighting apparatus comprising:

a base housing;

a yoke;

and a lamp housing;

wherein the lamp housing is remotely positionable relative to the yoke by a first motor about a first tilt axis;

wherein the yoke is remotely positionable relative to the base housing by a second motor about a first pan axis wherein the lamp housing is comprised of a plurality of light emitting modules;

wherein each of the plurality of light emitting modules articulate with the lamp housing about an individual tilt axis and an individual pan axis;

wherein each of the individual tilt axes and each of the individual pan axes of each of the light emitting modules can be positioned in a first state so that each of the plurality of light emitting modules emit light perpendicular to the lamp housing and parallel to each other;

wherein each of the individual tilt axes and each of the individual pan axes of each of the light emitting modules is configured to be positioned in a second state so that each of the plurality of light emitting modules emits light at a positive angle with respect to perpendicular to the lamp housing; and wherein each of the individual tilt axes and each of the individual pan axes of each of the light emitting modules is configured to be positioned in a third state so that each of the plurality of light emitting modules emits light at a negative angle with respect to perpendicular to the lamp housing.

* * * * *